United States Patent [19]

Fedorko

[11] 4,026,231

[45] May 31, 1977

[54] DEVICE FOR CONTROLLING BOAT SPEED

[76] Inventor: Irvin E. Fedorko, 22100 O'Conner St., St. Clair Shores, Mich. 48080

[22] Filed: Jan. 26, 1976

[21] Appl. No.: 652,101

[52] U.S. Cl. ..... 114/145 A

[51] Int. Cl.[2] ..... B63H 25/44

[58] Field of Search ..... 114/145 R, 145 A, 66.5 P, 114/66.5 A; 115/41 HT

[56] References Cited

UNITED STATES PATENTS

| | | | |
|---|---|---|---|
| 2,618,121 | 11/1952 | Tucker | 115/41 HT |
| 3,577,948 | 5/1971 | Frey | 114/66.5 P |
| 3,885,517 | 5/1975 | Borst et al. | 115/41 HT |

FOREIGN PATENTS OR APPLICATIONS

| | | | |
|---|---|---|---|
| 675,693 | 7/1952 | United Kingdom | 114/145 A |

*Primary Examiner*—Trygve M. Blix
*Assistant Examiner*—Jesus D. Sotelo
*Attorney, Agent, or Firm*—Burton, Parker & Schramm

[57] ABSTRACT

Relates to attachments to a motor boat for reducing the speed of the boat below the idling speed sufficient to permit trolling for fish. The speed controlling device includes a plate member mounted for movement from a vertical position immediately aft of the propeller and across the path of the propeller wash, thereby to slow the speed of the boat, to a second position away from the propeller and out of the path of the propeller wash. Hydraulic mechanism including a piston-cylinder combination unit is connected to a fixed support, such as the propulsion unit of the boat, and to the plate member for moving the latter between the aforesaid two positions of movement. Ports are provided in the cylinder for admitting fluid under pressure to either side of the piston to impart movement of the piston in either direction in the cylinder and to impart corresponding movement to the plate member. A rotary hydraulic pump is driven by a reversible electric motor to provide not only the source of fluid pressure for moving the piston plate member but also the port in the cylinder into which the fluid pressure is introduced for determining the direction of movement of the piston. A three-position electric switch is provided for controlling the operation of the electric motor either in one or the other of its two directions of rotation or for rendering the motor inoperative.

7 Claims, 9 Drawing Figures

DEVICE FOR CONTROLLING BOAT SPEED

BACKGROUND OF THE INVENTION

This invention relates to motorboat speed retarding devices and more particularly, but not necessarily, to trolling plates.

Prior workers in this art have recognized that in many instances when an extremely slow boat speed is desirable such speed is not attainable with a propeller driven boat at "idle" speed. Moreover, when a gasoline operated motor is operated for prolonged period of time at "idle" speed, it will foul and often stall. To avoid this situation, it is advisable and necessary to occasionally increase the RPM of motor to motor dislodge the builtup carbon which, if performed during a trolling run, is disturbing to the fish and consequently is responsible for the loss of many potential fish catches.

Various devices suggested by past workers in this art have in the main been limited to mechanically operated devices for disposing a trolling plate or the like either in operating position immediately aft of the propeller and transverse to its wash or in an inoperative position out of the way of the propeller's wash. Usually, the trolling plate was hinged for movement between the operative and inoperative positions of the plate, but occasionally the trolling plate was mounted for vertical rectilinear motion between these two positions. Such mechanical devices have been relatively expensive to construct and maintain and contained complicated parts and assemblies, some of which were relatively fragile, which could be easily damaged or otherwise impaired in usage. Regardless of the mounting arrangement considerable effort and time has been required in the past on the part of the boaters or fishermen to vary the positions of the trolling plate within its operating range.

In view of these difficulties and problems, it is apparent that improvements are needed in this art and especially in the direction of simpler, easier to control and more durable types of apparatus.

SUMMARY OF THE INVENTION

Accordingly, an important object of the invention is to improve the operation of motorboats such that they may be slowed down to a snail's pace, or even stopped completely, while concurrently having superior steering control over the boat's behavior.

Another important object of the invention is to provide an improved speed controlling device for powered water craft and more particularly, for reducing the speed thereof to less than the idling speed of the craft's propulsion unit.

Another important object of the invention is to provide a power operated mechanism in lieu of manual force for moving a trolling plate or the like either into operative position immediately aft of the propeller or into inoperative position away from the propeller.

Another important object of the invention is to provide a power operated mechanism for moving a trolling plate between extreme positions of operation and ineffectiveness which will also self-lock the trolling plate against movement in any position in that range once the power applied to move the plate has been discontinued.

Another important object of the invention is to provide a hydraulic power system for moving a trolling plate between extreme positions of operation and ineffectiveness and for controlling the power system's operation by a simple and operator convenient control element.

A further important object of the invention is to provide an improved speed controlling device for motorboats which is rugged and durable in usage and which is economical to construct, assemble and maintain.

The objects of the invention are effectively and efficiently carried out by a significant cooperation of electromechanically and hydraulically operated parts of the motorboat speed controlling attachment. For example, in the illustrated embodiment of the invention, an extensible and contractible link is incorporated into a force transmitting linkage system and use is made of its variations in length for adjusting the position of a trolling plate or the like which when functioning is submerged in the propeller's wash. Such a link herein takes the form of a cylinder-piston unit wherein the piston has a rod extending externally of the cylinder and wherein fluid under pressure is controllably directed into the cylinder on opposite sides of the piston thereby to move the piston and trolling plate. The fluid under pressure is derived from a rotary pump which is driven by a reversible electric motor and in a rotary direction corresponding to that of the motor. Two conduits connect the output of the pump to ports into the cylinder on opposite sides of the piston, and valving means responding to the direction of rotation of the pump will deliver fluid under pressure to either one of the two cylinder ports while permitting the fluid to escape from the other port. Moreover, the valving system can be such that when the rotary pump is discontinued it is self-operable to block exit of fluid from either port thereby positively hydraulically self-locking the trolling plate in any adjusted position of its range of movement.

The electric motor in turn is connectible to a source of energy in the boat, such as a battery associated with the boat propulsion unit, whereby with the use of a simple three-position switch not only can the electric motor be rotated in one or the other direction, or stopped, but two of the positions assumed by the switch are determinative of whether the trolling plate is moved toward its operative position rearward of the propeller or toward its ineffectual position away from the propeller wash. In other words, by the expedient of a lightweight, simply designed electric control switch, which can be portable for the convenience of the operator, it is possible to control the trolling speed of the motorboat from a position remote from the stern.

Various other objects, advantages and meritorious features of the invention will become more fully apparent from the following specification, appended claims and accompanying drawing figures, wherein:

DESCRIPTION OF A PREFERRED EMBODIMENT

Utilizing the water craft's existing power supply, an electrically driven hydraulic pump is arranged to deliver fluid under pressure selectively to parts of an externally mounted cylinder having a piston therein, which in turn by the extension and retraction of the piston's rod or shaft, and by the connection of the rod to the "troll plate," will shift the plate varying degrees in the desired location in order to attain the desired trolling speed. Actuation of this hydraulic system in this manner is brought about by a reversible electric motor drivingly coupled to a rotary hydraulic pump and operator manipulation of an electric control switch for the motor for operating both the motor and the pump in one or the other direction of rotation or for discontinuing the motor's operation. The system enables the trolling plate to be raised or lowered to any desired position within its range of movement and with the aid of additional features to be described to maintain the desired position against pressures exerted by the propeller's wash against the trolling plate.

Figure 1:
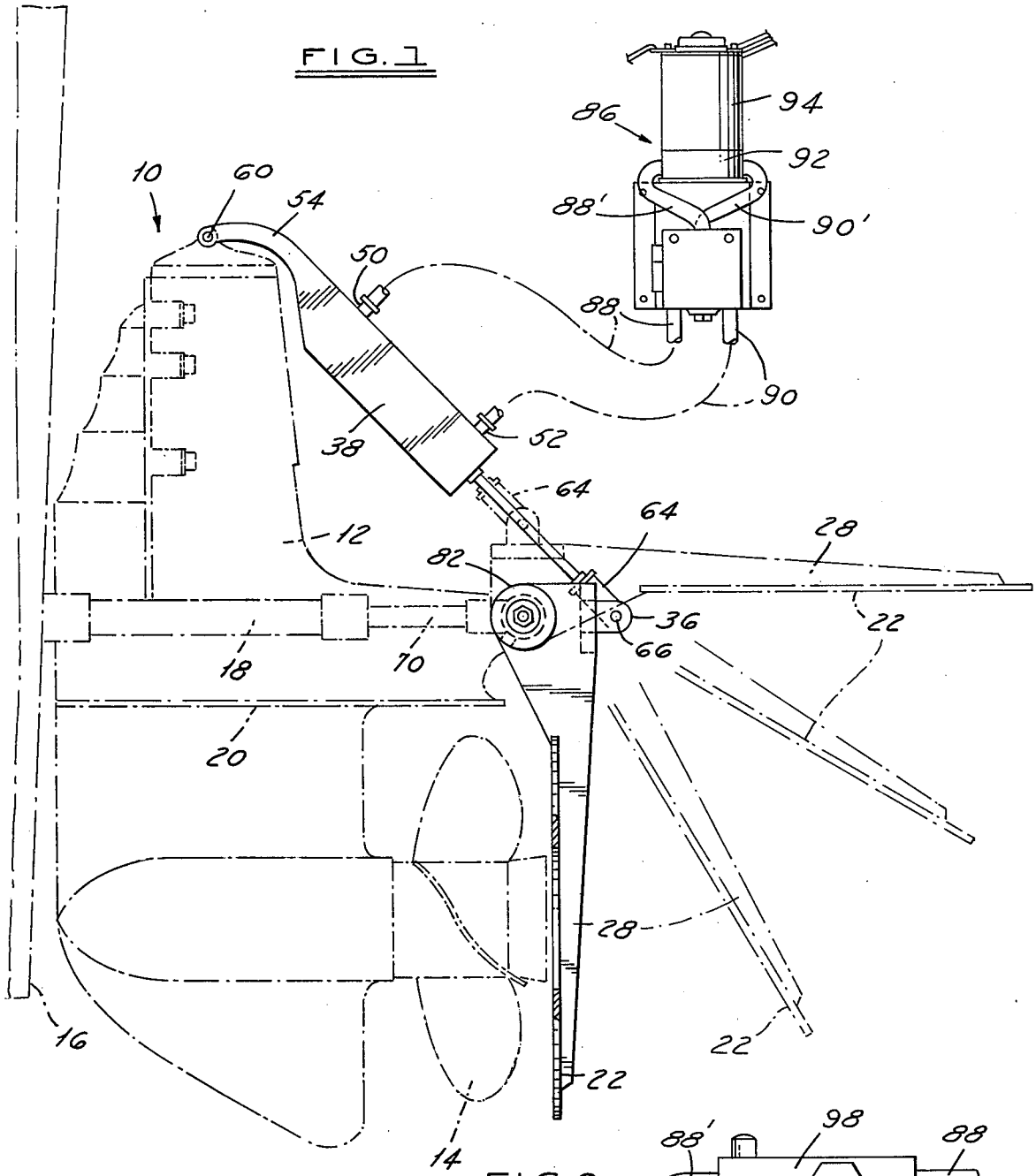
FIG. 1 is an overall system view of an embodiment of the invention including a trolling plate device, shown in full line and in side elevation, and its power unit, shown in full line and in top plane view, with the trolling plate device mounted on an outboard type motorboat propulsion unit shown in dashed outline and having a rotary propeller, the trolling plate is shown in full line vertical position for maximum effectiveness and also shown in dashed outline in several angular positions including the fully inoperative horizontal position.
Figure 2:
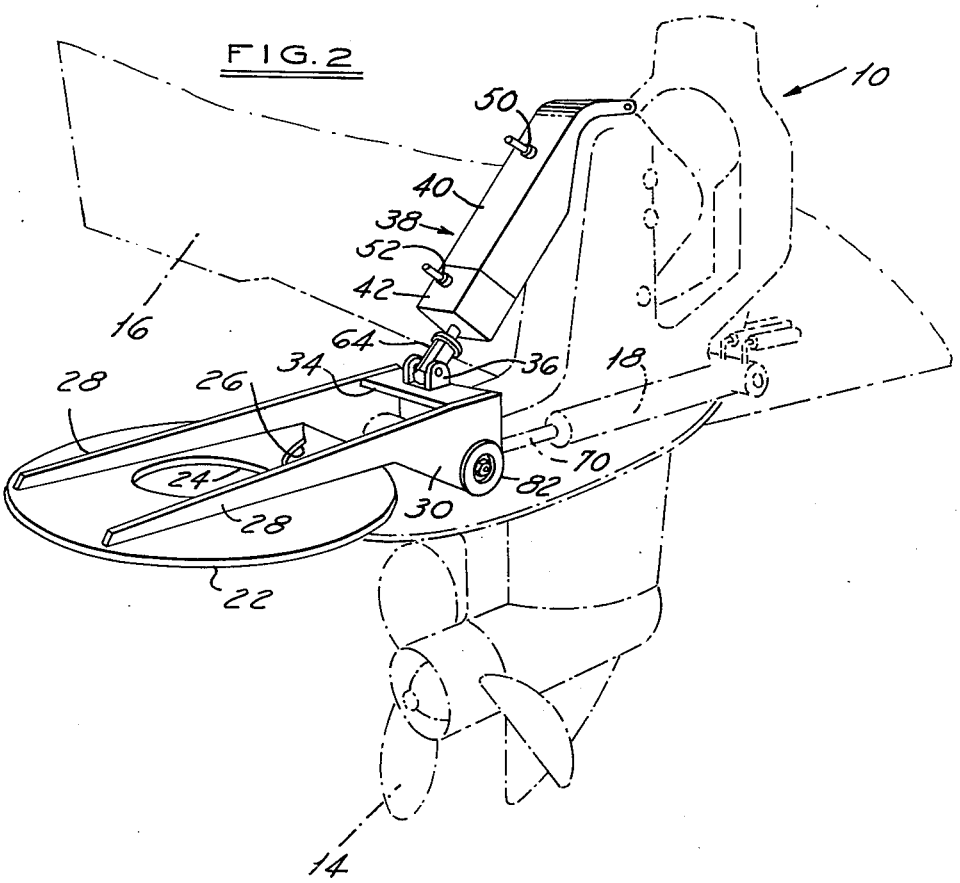
FIG. 2 is a perspective view of the trolling plate device shown in full line and in inoperative horizontal position on the propulsion unit of a motorboat, the latter being shown in dashed outline.
Figure 3:
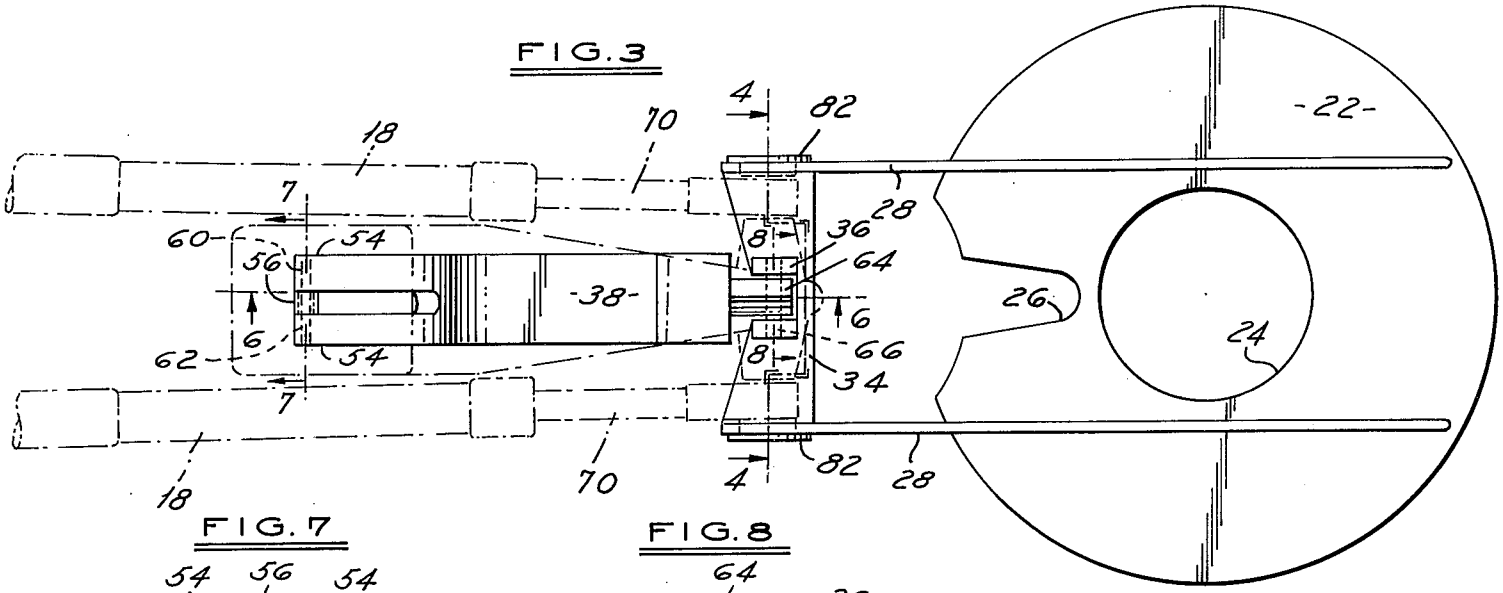
FIG. 3 is a top plane view of the trolling plate device with the trolling plate in horizontal position.

Referring initially to FIGS. 1, 2 and 3, the reference character 10 generally illustrates the outline of a marine propulsion unit having a housing 12 for an appropriate engine and a propeller 14 driven by the engine. As is customary the propulsion unit is mounted on the boat's stern indicated at 16 and the unit may be of the inboard, inboard-outboard or outboard type. Such types of propulsion units are capable of being pivoted to swing the propeller toward the surface of the water and for this purpose a pair of extensible hydraulic cylinders 18—18 are provided, one on each side of the engine housing as shown in FIG. 3, which when extended are capable of rocking the propulsion unit about a horizontal axis for swinging the propeller 14 in an upward counter clockwise direction for its position in FIG. 1. The forward ends of the hydraulic cylinders 18—18 take support from the stern of the boat, and their rearward ends are joined by a cross shaft received within a bushing to be more fully described hereinafter in connection with the mounting of the trolling plate or vane of the illustrated embodiment. As is customary, the propulsion unit 10 is shaped to be provided with an anti-cavitation plate 20 which is illustrated in FIGS. 1 and 2 and is located slightly below the pair of hydraulic cylinders 18—18.

Figure 4:
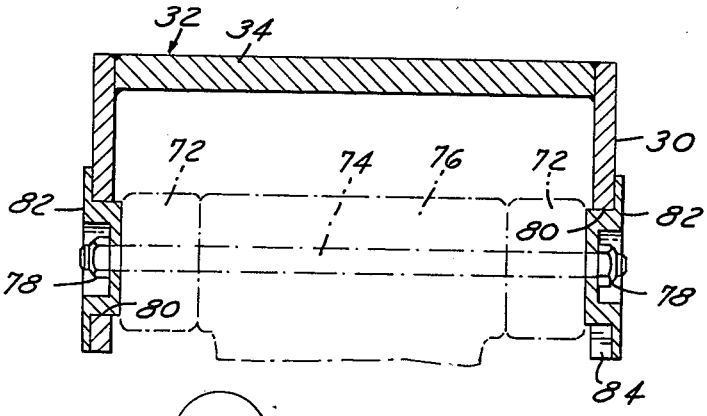
FIG. 4 is a longitudinal sectional view taken along line 4—4 of FIG. 3 showing the construction of the inverted U-shaped bracket for hinging the trolling plate to the propulsion unit of the boat.
Figure 8:
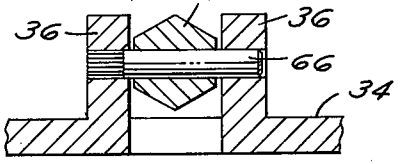
FIG. 8 is an enlarged detail sectional view taken along line 8—8 of FIG. 3 and illustrates the manner of pivotally connecting the opposite end of the piston-cylinder unit of FIG. 6 to the fulcrum arm of the trolling plate.

The speed controlling device of the present invention comprises several main components to which general reference will first be made before describing their specific relations and connections to one to the other. The speed control or trolling plate is generally indicated at 22 and is herein illustrated as a flat annularly shaped member having a central hole 24 therethrough and a notch 26 entering the outer periphery of the member in the manner shown in FIG. 3. The annular troll plate 22 is rigidly secured to a pair of arms 28—28 which overlie the outboard side of the plate. The two arms form integral extensions of the side walls 30—30 of an inverted U-shaped bracket member 32 whose formation is best shown in FIG. 4. The inverted U-shape of the bracket is completed with a top member 34 having a pair of upstanding lugs or ears 36—36 (FIGS. 4 and 8) forming part of a pivotal connection to be described more fully hereinafter. It is evident from FIGS. 1 and 2 that when the speed control device is properly mounted on a propulsion unit of a boat, the trolling vane or plate 22 is movable from the vertical position shown in full line in FIG. 1, where the plate is immediately aft of the propeller and crosswise to the wash from the propeller, to a horizontal position shown in dashed outline in FIG. 1 where the plate is away from the propeller and located wholly above and parallel to the plane of the cavitation plate 20.

To move the trolling plate 22 between its two extreme positions shown in FIG. 1, an extensible and retractible member is employed in the form of a cylinder-piston combination unit generally indicated at 38. The cylinder-piston unit forms a link in a linkage system acting as a force applying mechanism for moving the trolling plate relative to the propeller.

Figure 7:
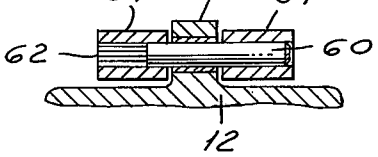
FIG. 7 is a detail sectional view taken along line 7—7 of FIG. 3 and illustrates the manner of pivotally connecting one end of the cylinder of FIG. 6 to the propulsion unit of the motorboat.
Figure 6:
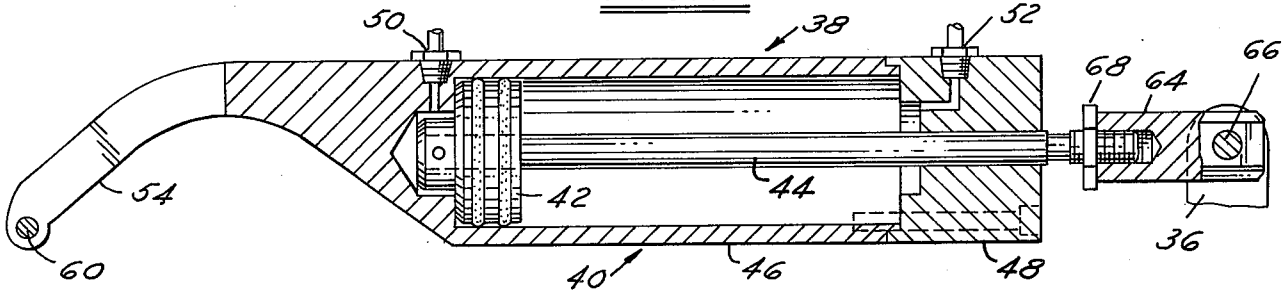
FIG. 6 is a longitudinal sectional view of a piston-cylinder combination unit which is taken along line 6—6 of FIG. 3 and which serves as a link in a force applying linkage system for adjusting the position of the trolling plate.

The cylinder-piston unit 38 is illustrated in detail in FIG. 6 and comprises the cylinder 40, a piston 42 slidably therein, and a rod or shaft 44 connected at one end to the piston and projecting externally of the cylinder for ultimate effective connection to the trolling plate 22. The cylinder is actually formed of two parts, a major body portion 46 and an end cap portion 48 bolted or otherwise secured to the open end of the cylinder portion 46. At the extreme ends of the chamber in which the piston moves are ports indicated at 50 and 52 through which fluid under pressure is passed to enter the chamber on one side of piston while fluid concurrently escapes from the chamber on the other side of the piston. One end section of the cylinder is curved and slotted to form a bifurcation having spaced parallel sections 54—54 capable of straddling an ear 56 as shown in detail in FIG. 7. As illustrated in FIGS. 1 and 2, the ear 56 is located atop of the engine housing of the propulsion unit and a pivot pin 60 extends therethrough and into the straddling bifurcated sections 54—54 of the curved portion of the cylinder thereby to form a pivotal connection. More specifically, the central portion of the pin 60 is rotatably journaled in the ear 56 but because one of its outer extremities has knurling 62 and makes tight fitting engagement with one of the bifurcated sections 54 the pivot pin is rigidly held from movement relative to the bifurcated sections. By this provision, the upper end of the cylinder-piston unit 38 is capable of swinging movement about a horizontal axis relative to the engine housing.

The external end of the piston rod 44 is pivotally coupled to the upstanding pair of lugs or ears 36—36 carried by the top wall 34 of the bracket 32 which through its arms 28—28 is rigidly connected to the trolling plate 22. A desirable form of pivotal connection is that shown in FIG. 6 wherein the outer end of the rod 44 is externally threaded for engagement with an internally threaded bore of an adjustable connector 64 which may be polygonally shaped in cross-section as shwon in FIG. 8. The opposite end of the connector 64 has a transverse circular hole therethrough which when properly inserted between the pair of ears 36—36 of the bracket 32 will align with the holes in the ears. A knurled pin 66 similar to pin 60 is received through the aligned holes of the ears 36—36 and the adjustable connector 64. The knurled section of the pin 66 rigidly locks the pin against rotation in the pair of ears 36—36. However, the middle portion of the pin 66 serves as a journal for the outer end of the connector 64. It is thus apparent that the cylinder-piston unit 38 is pivotally connected at its opposite ends, one end to the top of the engine housing and the other end to the ears 36—36 of the bracket 32 forming the hinge mounting for the trolling plate 22. It is also apparent that threaded adjustment can be made between the piston rod 44 and the connector 64 to suit the circumstances encountered when the device is attached on different mountings. A nut 68 threaded on the end of the piston rod serves to lock the connector member 64 in adjusted position.

As earlier mentioned in the specification, the pair of hydraulic cylinders 18—18 on either side of the engine housing 12 are joined at their outer ends by a cross shaft received within a bushing for the purpose of swinging the propeller assembly to a higher level in the water. More specifically, when fluid under pressure is introduced into the forward ends of the cylinders 18—18 from a common source of fluid pressure their respective internal pistons and associated rods 70—70 move rearwardly away from the stern of the boat to swing, the propeller and its drive assembly rearwardly and upwardly toward the surface of the water. The rear ends of the piston rods 70—70 are rigidly connected to laterally spaced apart bushings 72—72 which in turn are journaled on a cross shaft 74 as shown in FIG. 4. The space between the bushings 72—72 is occupied by a journal mount 76 surrounding the shaft 74 and forming part of the engine housing above and slightly aft of the rear end of the cavitation plate 20 in the manner illustrated in FIG. 1. The opposite ends of the shaft 74 are each capped by a nut 78 threaded thereon as shown in FIG. 4. This provision for raising the propeller assembly of the propulsion unit 10 forms no part of the present invention in of itself, but advantage is taken of the cross shaft 74 to also serve as the hinge mounting for the trolling plate 22 in the following manner.

Figure 5:
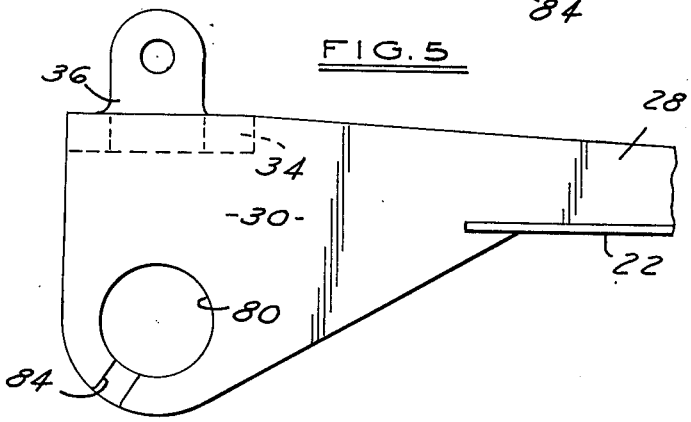
FIG. 5 is a fragmentary side elevation of the bracket portion shown in FIG. 4 for hinging the trolling plate and showing a slot or notch in one side wall of the bracket for sliding the same onto one end of a bearing shaft.

The side walls 30—30 of the inverted U-shaped bracket member 32, as best shown in the detail views of FIGS. 4 and 5, are each provided with a circular aperture 80 of corresponding diameter and axially aligned with one another. Each aperture 80 is oversize the end of the shaft 74 and the nut 78 threaded thereon as is evident in FIG. 4. A dished-shaped washer 82 has its central portion apertured to ride on the end of the shaft 74 and interfit between each nut 78 and the adjacent bushing 72. The outer perimeter of the washer lies flat against the outer face of the adjacent wall 30 of the bracket member 32. When so assembled it is apparent that each washer 82 is rigidly secured by its associated nut 78 to its respective end of the shaft 74 and that each wall 30 of the bracket member is of a size to rotatingly bear upon the shoulder of the washer which joins the inner and outer parts of the washer thereby enabling the bracket member to pivot about the axis of the shaft 74 in response to movement of the piston rod 44.

However, in order to assemble the parts of the pivotal mount for the bracket member 32, a notch or slot 84 is formed in one wall 30 of the bracket member which opens into the circular aperture 80 in the manner shown in FIG. 5. With the presence of the slot 84 in one wall of the bracket member 32 and the removal of the two nuts 78—78, it is now possible to first position the aperture of the unslotted wall 30 of the bracket member 32 over one of the threaded ends of the shaft 74 and then drop down the opposite wall 30 of the bracket member having the slot 84 so that the other threaded end of the shaft passes through the slot and into the circular aperture 80. Thereafter, the two washers 82—82 are assembled on the opposite ends of the shaft 74 and rigidly secured in place by the clamping action of the nuts 78 as they are threaded home and the adjacent faces of the bushings 72—72. Thus, each washer acts as a radial spacer and journal mount for its respective side wall 30 of the bracket member 32 thereby enabling the trolling plate 32 to assume various pivotal positions within its range of movement such as shown in FIG. 1.

Figure 9:
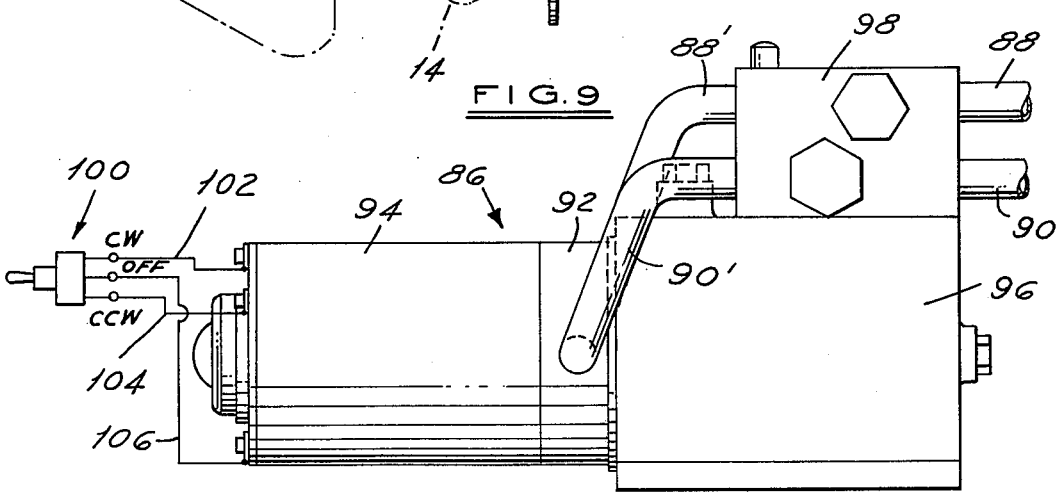
FIG. 9 is an enlarged side elevation of the electric hydraulic pump assembly unit forming the power unit of the trolling plate device referred to in the brief description of FIG. 1.

The source of fluid pressure for operating the boat speed control device is a hydraulic pump which in the illustrated embodiment of the invention forms a part of a unitary assembly generally indicated at 86 in FIGS. 1 and 9. From this assembly two conduits 88 and 90 extend which are connected as illustrated in FIG. 1 to the two ports 50 and 52 respectively of the hydraulic cylinder-piston unit 38. The unitary assembly is capable of delivering fluid under pressure to one or the other of the two conduits 88 and 90 to introduce such fluid pressure into either port 50 and 52 while the remaining conduit and associated port are concurrently returning fluid to the hydraulic fluid source. In this manner the piston 42 in the cylinder 40 is caused to move in one or the other direction between the two ports and either raise or lower the speed control plate 22 so that it may assume various positions in its range of movement.

In the illustrated embodiment of the invention the hydraulic pump forms part of the unitary assembly 86 and is represented in such assembly at 92. Nevertheless, a different source of such fluid pressure may be employed and have its fluid pressure outlet directed to either one of the ports 50 and 52 by manually controlled valves. Distinct advantages are gained by the use of the specially designed electric-hydraulic combination pump of the assembly 86. It enables a small electrical device, a manually operated electric switch to control the movements of the trolling plate, which switch may be installed at any convenient location on the boat or left in a portable state and operated in various positions in the boat. Another advantage of the unitary assembly is the inclusion of a double pilot check valve component which hydraulically prevents any leakage of fluid either into or out of the ports 50 and 52 of the cylinder-piston unit 38 when the trolling plate has been moved to the desired position thus locking the trolling plate in such position against the force of the propeller wash.

Electrically driven hydraulic pump devices of the general nature of the unitary assembly illustrated at 86 in FIGS. 1 and 9 are known. The particular one illustrated herein is manufactured and sold by Fluid Controls Incorporated, 8341 Tyler Boulevard, Mentor, Oh., 44060. It is composed of several components assembled into the compact unit shown at 86 and generally comprises the previously mentioned rotary hydraulic pump 92 driven by a reversible electric motor 94, an oil reservoir and pump housing 96, and the previously mentioned double pilot check valve component 98. In the assembly 86, the electric motor 94 is located on one side of the rotary hydraulic pump 92 and the oil reservoir 96, which contains a part of the hydraulic fluid in the system, is located on the other side. The pilot check valve component 98 is mounted on top of the oil reservoir 96 from which the conduits 88 and 90 extend for connection to the ports 59 and 52 of the cylinder unit 38. The pump 92 has two conduits 88' and 90' leading to the double pilot check valve 98 and form initial portions of the corresponding main conduits 88 and 90 respectively leading to the ports 50 and 52. The hydraulic pump contains an outer rotor and an inner rotor which are so designed that, depending upon the direction of the rotation of the electric motor and pump, will cause hydraulic fluid to be induced from the reservoir and be discharged under pressure by the pump through conduit 88' or conduit 90'.

The double pilot check valve 98, in turn, senses which of the two conduits 88' or 90' contains the fluid under pressure being discharged by the pump and adjusts the check valves therein to permit such fluid to enter either corresponding conduit 88 or 90 while at the same time permitting fluid to return from the cylinder unit 38 by way of the other conduit 88 or 90 for flow into the reservoir 96. Without the pilot check valve component in the system, it was found that the force of the propeller wash acting on the trolling vane or plate is likely to slowly move the piston 42 in the cylinder 46 so that hydraulic fluid on the advancing side of the piston would slowly leak out of the port toward which the piston is moving while concurrently hydraulic fluid would enter the cylinder through the other port. The result would be to slowly change the position of the trolling plate rearwardly away from its desired adjusted position and towards its inoperative horizontal position. With the pilot check valve component incorporated into the system, the trolling plate is capable of being hydraulically locked against such movement after cessation of the rotation of the pump 92 and the motor 94 driving the same. In doing so, the pilot check valve component senses the equalization of pressure on opposite sides of the piston 42 and adjusts the valves therein to bar flow of hydraulic fluid in either direction through the conduits 88 and 90 and the ports 50 and 52. This positively locks the plate 22 against any outside fluid pressures.

The operation and direction of rotation of the electric motor 94 is controlled by an electric switch generally indicated at 100 in FIG. 9 which may be of the three-position type illustrated wherein the switch control member is movable to anyone of three positions to effect rotation of the motor either in the clockwise direction (CW) or counter clockwise direction (CCW) or to disconnect the motor from an electrical source of energy in the boat such as the battery 108. Preferably the "stop" or off position of the switch is located between the clockwise and counter clockwise positions as shown. Leads 102, 104 and 106 extend from these switch contact positions to appropriate terminals on the motor housing. As previously mentioned the switch 100 may be installed in any suitable location on the boat or be portable for location at several suitable operator control positions in the boat. It is also apparent that the finger touch control enables the adjustment of the trolling plate to be judiciously and accurately performed with little inconvenience to the operator in order to obtain the desired boat speed.

While a particular embodiment of the invention has been shown and described, it will be understood, of course, that it is not desired that the invention be limited thereto since modifications may be made, and it is therefore contemplated by the appended claims to cover any such modifications as fall within the true spirit and scope of the invention.

What is claimed is:

1. A trolling device adapted to be mounted on the movably supported outboard housing of a boat's propulsion unit, which housing has an upper mounting pivot and a lower and rearwardly disposed mounting pivot, comprising, in combination:

a trolling plate;

means for hinging the plate on the lower and rearwardly disposed mounting pivot of the outboard housing for swinging movement between a vertical position confronting the wash of a propeller on the housing and a horizontal position disposed out of the path of the propeller wash;

an elongated longitudinally extensible and contractable remotely operable powering unit;

means for connecting one end of the powering unit to the upper mounting pivot of the housing and means for connecting the opposite end of the powering unit to said plate whereby all forces of extension or contraction of the powering unit are between said upper mounting pivot on the housing and the trolling plate;

a source of power adapted to be mounted in the boat and including flexible power delivering means extending out of the boat and to said powering unit on the housing for delivering the power thereto;

and control means adapted to be mounted in the boat for manipulation by the boat operator for controlling delivery of power from said source to said powering unit to cause the same to be extended or contracted to lower or raise the trolling plate.

2. The invention defined by claim 1 wherein the powering unit comprises a fluid pressure cylinder and piston.

3. The invention defined by claim 2 wherein said source of power in the boat is an electric-hydraulic pump, and said flexible power delivering means comprise flexible hydraulic pressure hoses.

4. The invention defined by claim 3 wherein said control means comprises an electric reversing switch for the electric-hydraulic pump.

5. The invention defined by claim 3 wherein said control means includes valve means for selectively blocking the flow of fluid pressure into or out of the fluid pressure cylinder.

6. The invention defined by claim 1 wherein said trolling plate includes upstanding ear means thereon disposed substantially perpendicular to the plane of the plate, and said means for connecting the powering unit to the plate comprises an adjustable end portion pivotally connected to the ear means.

7. The invention defined by claim 1 wherein said trolling plate includes a pair of opposed spaced apart side walls adapted to overlie opposite sides of the lower and rearwardly disposed mounting pivot of the housing, said side walls provided with opposed circular apertures and at least one side wall having a slot opening from the aperture through an edge of the side wall, and bushing means nestable in the apertures and adapted to be mounted on a pivot shaft secured in the lower and rearward mounting pivot of the housing.

* * * * *